US007114789B2

(12) United States Patent
Keaton

(10) Patent No.: US 7,114,789 B2
(45) Date of Patent: Oct. 3, 2006

(54) OFFSET RAIL SPLICE ARRANGEMENT FOR A MOBILE STORAGE SYSTEM

(75) Inventor: William R. Keaton, Brookfield, WI (US)

(73) Assignee: Spacesaver Corporation, Fort Atkinson, WI (US)

( * ) Notice: Subject to any disclaimer, the term of this patent is extended or adjusted under 35 U.S.C. 154(b) by 0 days.

(21) Appl. No.: 10/354,364

(22) Filed: Jan. 30, 2003

(65) Prior Publication Data

US 2004/0150299 A1 Aug. 5, 2004

(51) Int. Cl.
*A47B 53/00* (2006.01)

(52) U.S. Cl. ..... 312/132; 312/201; 104/287

(58) Field of Classification Search ..... 312/132, 312/198–201, 249.1; 238/230, 231, 233, 238/234, 246, 248; 104/287
See application file for complete search history.

(56) References Cited

U.S. PATENT DOCUMENTS

| | | | | | |
|---|---|---|---|---|---|
| 109,210 | A | | 11/1870 | Hill | |
| 272,617 | A | | 2/1883 | Armstrong | |
| 428,757 | A | * | 5/1890 | Kelly | 238/234 |
| 743,172 | A | * | 11/1903 | Kaufman | 238/234 |
| 919,280 | A | * | 4/1909 | Akers | 238/231 |
| 1,081,878 | A | * | 12/1913 | Wiley | 238/231 |
| 1,176,872 | A | * | 3/1916 | Stowell | 238/231 |
| 1,241,901 | A | * | 10/1917 | Autrey et al. | 238/231 |
| 3,139,364 | A | | 6/1964 | Fiechter | |
| 3,309,022 | A | | 3/1967 | Ingold | |
| 3,366,334 | A | | 1/1968 | Broske | |
| 3,528,608 | A | | 9/1970 | Dashew et al. | |
| 3,944,309 | A | * | 3/1976 | Taniwaki | 104/287 |
| 4,307,922 | A | | 12/1981 | Rhodes, Jr. | |
| 4,417,524 | A | * | 11/1983 | Quinn et al. | 104/287 |
| 4,467,924 | A | | 8/1984 | Morcheles | |
| 4,618,191 | A | * | 10/1986 | Peterman | 312/201 |
| 5,205,627 | A | * | 4/1993 | Davison et al. | 312/201 |
| 5,249,654 | A | | 10/1993 | Bruning | |
| 5,251,732 | A | | 10/1993 | Bruning | |
| 5,267,634 | A | | 12/1993 | Bruning | |
| 5,435,639 | A | | 7/1995 | Smits et al. | |

* cited by examiner

*Primary Examiner*—Peter R. Brown
(74) *Attorney, Agent, or Firm*—Boyle, Fredrickson, Newholm, Stein & Gratz, S.C.

(57) ABSTRACT

A splice arrangement for rail sections in a rail-mounted mobile system, such as a mobile storage system. The rail arrangement includes first and second rail sections, each of which has a base member and a support member defining a support surface for supporting the movable member of the mobile storage system. The base members of the adjacent rail sections are adapted for placement adjacent each other to form a joint therebetween. The support members of the adjacent rail sections are also adapted for placement adjacent each other to define a joint therebetween. The support member joint is offset from the base member joint, such that the support member joint overlies a lower wall defined by one of the base members. The ends of the support members further include a tongue and groove arrangement for maintaining the support members in horizontal alignment with each other. Grout is typically applied between the base members and a support surface such as a floor, and the offset relationship between the support member joint and the base member joint functions to isolate the grout from vertical forces resulting from movement of the movable member from one rail section to the other.

12 Claims, 4 Drawing Sheets

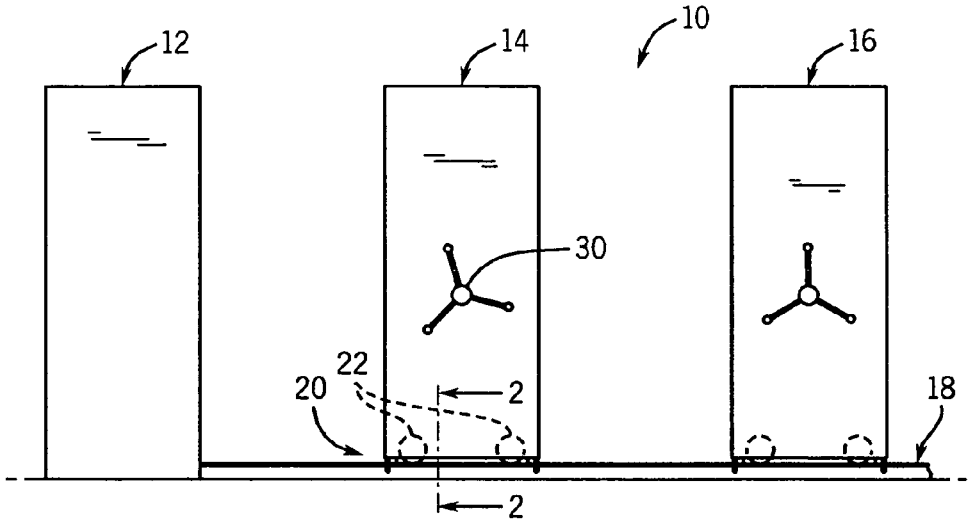
FIG. 1
FIG. 2
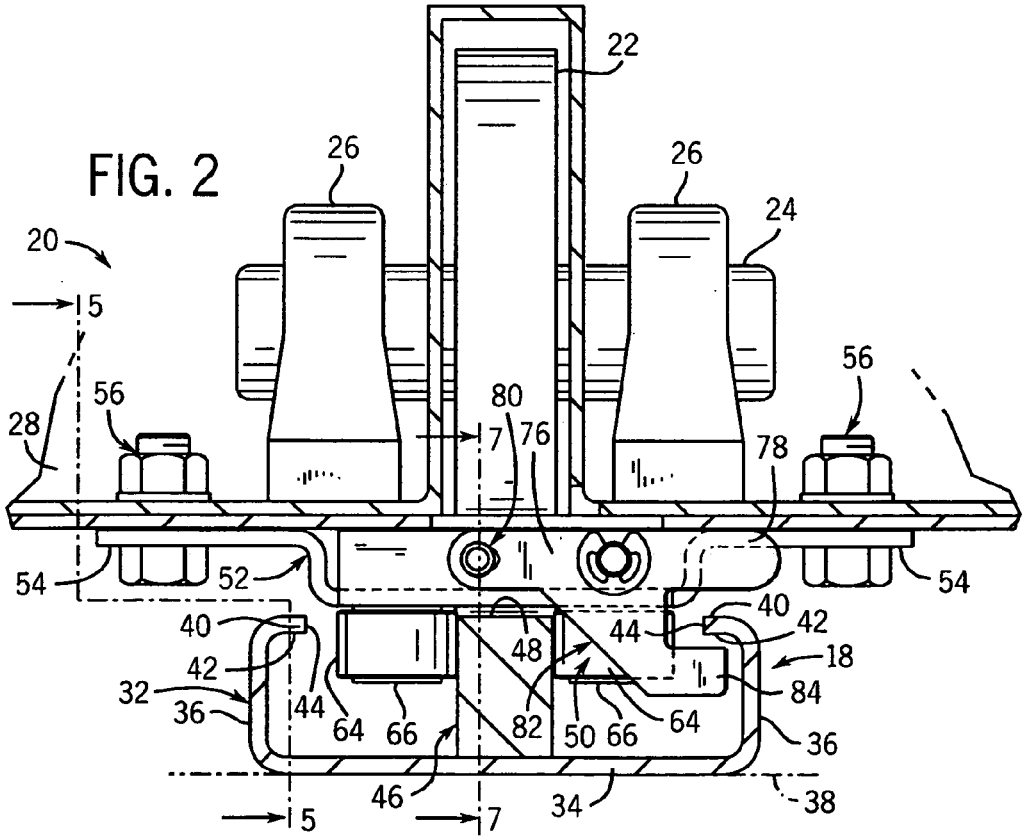

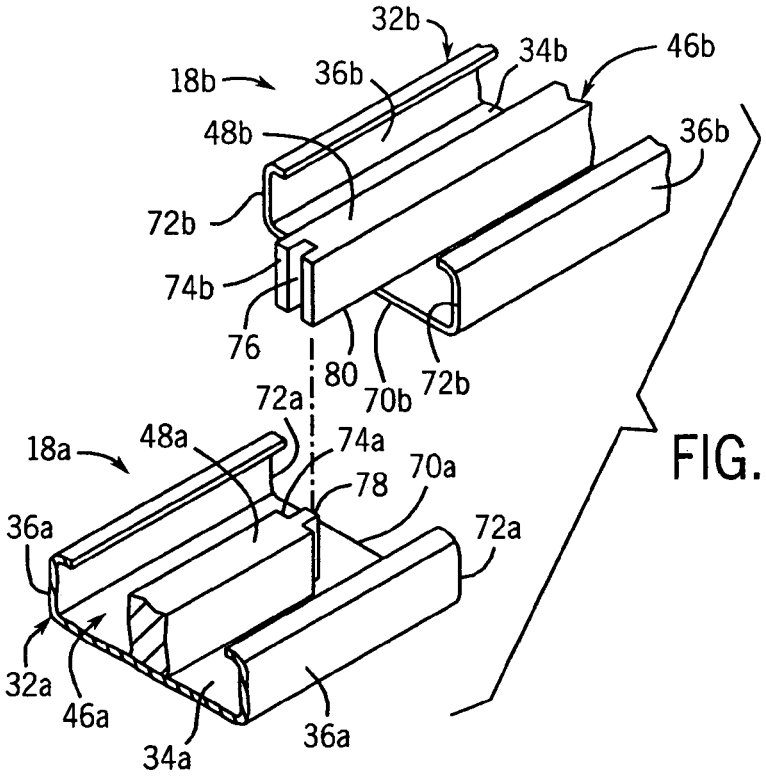
FIG. 3
FIG. 4
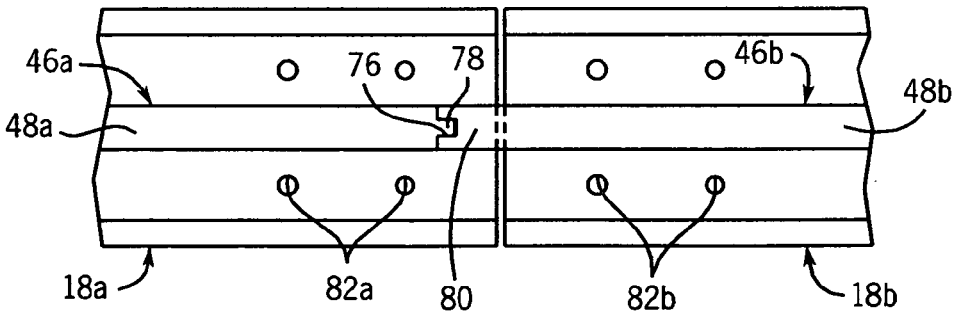
FIG. 5
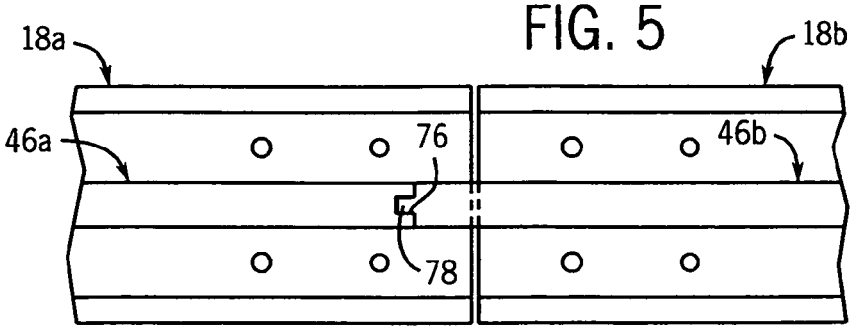

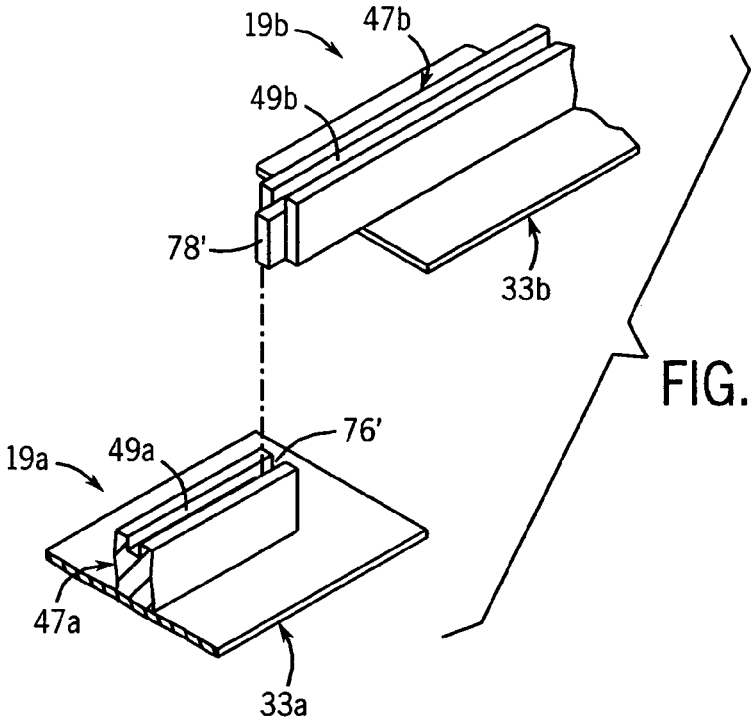
FIG. 6
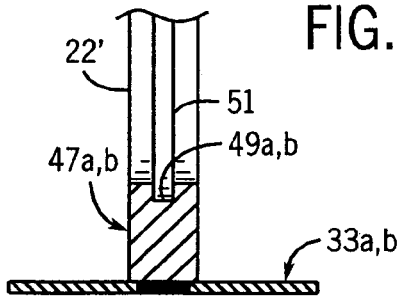
FIG. 7
FIG. 9
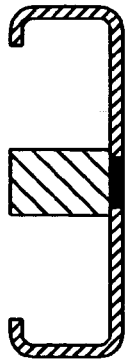
FIG. 8
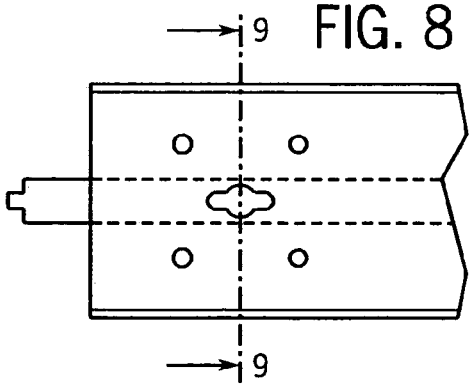

OFFSET RAIL SPLICE ARRANGEMENT FOR A MOBILE STORAGE SYSTEM

BACKGROUND AND SUMMARY OF THE INVENTION

This invention relates to a rail-mounted mobile system such as a mobile storage system, and more particularly to a rail splice arrangement for such a system.

A rail-mounted mobile system, such as a mobile storage system, includes one or more movable members supported on a series of spaced apart parallel rails. In a mobile storage application, the movable members are typically in the form of carriages having wheels that are supported on the spaced apart rails. A series of storage units, such as shelves or cabinets, are mounted to each carriage.

Prior art rail arrangements for mobile storage systems of this type typically include a series of rail sections that are aligned in end-to-end relationship to form a desired rail length. Splices or joints are formed between the ends of adjacent rail sections. Each rail section typically includes a base member and a support member defining a support surface with which the carriage wheels are engaged. The base member provides the means by which the support member is mounted to a support surface such as a floor, and includes provisions for leveling the support surface and for facilitating mounting of the rail section to the floor.

In a prior art rail construction, the base member of each rail section includes a lower wall, and the end of the support member is located in alignment with the end of the lower wall of the base member. Typically, the rail sections are positioned on a subfloor so as to be in alignment with each other, and the elevation of the rail sections is adjusted so as to level the support surfaces defined by the aligned support members. Grout is then injected into the space between the subfloor and the base members, to maintain the rail sections at the desired elevation. An upper floor is installed over the subfloor to raise the elevation of the finished floor to the level of the top of the base members of the rail sections. In this prior art construction, in which the ends of the support members overlie the ends of the base members, the movement of the loaded storage units over the splices or joints between the adjacent rail sections can cause the ends of the rail sections to apply a vertical pounding force on the grout below the base members as the carriage moves from one rail section to another. Over time, this can significantly deteriorate the condition of the grout and cause the support surfaces of the adjacent rail sections to be moved out of vertical alignment with each other. This vertical misalignment of adjacent support surfaces adversely affects operation of the system by creating a bump or drop, which the wheels of the carriage must negotiate in order to pass from one rail section to another.

It is an object of the present invention to provide a rail arrangement for a rail-mounted mobile system, such as a mobile storage system, which prevents vertical misalignment between the support surfaces of adjacent support members forming a part of adjacent rail sections. It is a further object of the invention to provide such a rail arrangement having a generally similar construction and operation as in the prior art, while maintaining the support surfaces of adjacent rail section support members in vertical alignment with each other. It is a further object of the invention to provide such a rail arrangement in which the support members of adjacent rail sections are maintained in horizontal alignment with each other. Yet another object of the invention is to provide such a rail arrangement which is configured so as to prevent grout located below the rail sections from being directly exposed to vertical forces resulting from movement of the carriage from one rail section to another.

In accordance with the present invention, a rail arrangement for a mobile storage system includes at least first and second rail sections that are adapted to be aligned with each other for supporting a movable member, such as a carriage associated with a mobile storage system. Each rail section includes a base member and a support member. The support members define upwardly facing support surfaces that are adapted to be engaged by wheels or the like associated with the carriage. The base members of the rail sections define facing ends that are adapted to be placed adjacent each other to form a joint therebetween. The support members of the rail sections also define facing ends that are adapted to be placed adjacent each other to form a joint therebetween. The joint between the support members of the rail sections is offset from the joint between the base members of the rail sections. In this manner, the joint between the support members of the rail sections overlies one of the base members, so that any vertical forces resulting from movement of the carriage wheels from one support member to another are applied to the base member rather than to the open area between the ends of the base members as in the prior art, to isolate the grout below the base members from the adverse effects of such forces.

The base member of each rail section is preferably formed to include a lower wall and a pair of upwardly extending side walls between which the support member of each rail section is located. The joint between the ends of the support members is located over the lower wall of the base member of one of the rail sections.

The joint between the ends of the support members further includes engagement structure for maintaining the support members in horizontal alignment with each other. The engagement structure may be in the form of a projection that extends from the end of one of the support members, and which is received within a groove formed in the end of the adjacent support member. The projection and the groove are configured so as to prevent lateral movement between the support members, to ensure that the support members remain in horizontal alignment.

The invention contemplates a mobile storage system having a rail arrangement, as well as a rail construction and a method of engaging a pair of rail sections, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 1 is a side elevation view showing a mobile system, in the form of a mobile storage system, which incorporates the rail splice arrangement of the present invention;

FIG. 2 is a partial section view taken along line 2—2 of FIG. 1;

FIG. 3 is a partial isometric view showing the ends of a pair of rail sections utilized to construct the offset splice or joint arrangement of the present invention, and which is incorporated in the mobile system of FIGS. 1 and 2;

FIG. 4 is a top plan view of the spliced rail sections of FIG. 3;

FIG. 5 is a top plan view similar to FIG. 4, showing a reverse configuration for the splice between adjacent rail sections;

FIG. 6 is an isometric view illustrating an alternative configuration for the rail sections adapted to be joined together using the rail splice arrangement of the present invention;

FIG. 7 is a section view through one of the rail sections of FIG. 6;

FIG. 8 is a bottom plan view showing one of the rail sections of FIGS. 3 and 4;

FIG. 9 is a section view taken along line 9—9 of FIG. 8;

DETAILED DESCRIPTION OF THE INVENTION

Figure 10:
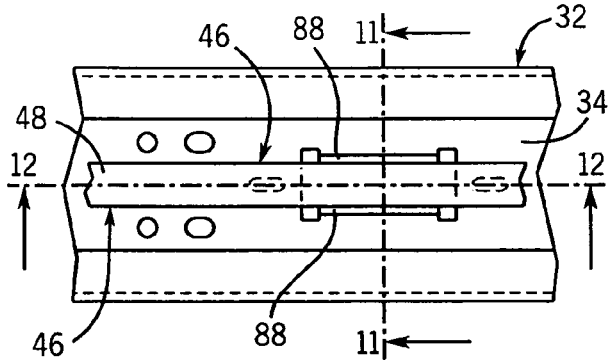
FIG. 10 is a top plan view showing one of the rail sections of FIGS. 3–5 and a locating feature for positioning the support member of the rail section relative to the base member of the rail section.

As shown in FIG. 1, a mobile system, in the form of a mobile storage system 10, includes a series of storage units 12, 14 and 16. Storage unit 12 is stationary, and storage units 14 and 16 are movably supported on a series of parallel, spaced apart rails 18 in a manner as is generally known. Storage units 14, 16 are movable on rails 18 together and apart, to selectively create an aisle or space for providing access to the contents of storage units 12, 14 and 16. Representatively, the general construction and operation of mobile storage system 10 is similar to that of mobile storage systems such as are available from Spacesaver Corporation of Fort Atkinson, Wis.

Each of mobile storage units 14, 16 includes a carriage 20, the lower portion of which is shown in FIG. 2. In accordance with known construction, each carriage 20 spans across the parallel rails 18 for movably supporting the storage units 14, 16 on rails 18. Each carriage 20 includes a series of wheels 22, each of which is mounted to an axle 24 mounted for rotation within a pair of conventional bearing or pillow blocks 26. Carriage 20 includes a series of frame members, such as a horizontal frame member 28, to which bearing blocks 26 are mounted. In a known manner, certain of wheels 22 are powered for longitudinal movement along rails 18 by a known manual or electric drive system. In a representative embodiment as illustrated in FIG. 1, a manual hand wheel 30 provides input power to the drive arrangement, which typically incorporates a chain and sprocket drive (not shown) for driving a selected one of axles 24 through rotation of hand wheel 30.

Each rail 18 includes a base or channel member 32 having a bottom wall 34 and a pair of spaced apart side walls 36. Bottom wall 34 is adapted for placement over a support surface 38 such as a subfloor, such that channel member 32 is upwardly open. Each side wall 36 of channel member 32 extends upwardly from one of the ends of bottom wall 36, and terminates in an inwardly extending lip 40 at its upper end. The underside of each lip 40 defines a downwardly facing and laterally extending engagement surface 42. In the illustrated embodiment, each engagement surface 42 is spaced above and parallel to the upwardly facing surface of bottom wall 34. Each lip 40 terminates in an inwardly facing end 44.

Rail 18 further includes a longitudinally extending support member 46, which is mounted to bottom wall 34 of channel member 32 and is positioned generally midway between side walls 36. Support member 46 is in the form of a bar having a generally rectangular cross section, defining an upwardly facing support surface 48 with which wheels 22 are engaged for providing movement of carriage 20 along rail 18. Support surface 48 is located at or below the upper surface of lips 40, such that rail 18 defines a low profile cross section and does not have an upwardly extending component that may cause tripping of the users of storage system 10. The bottom surface of support member 46 is secured to channel member bottom wall 34, such as by welding, in a manner to be explained.

An anti-tip member 50 is carried by carriage 20 so as to be movable along with the storage unit such as 14, 16. In the illustrated embodiment, anti-tip member 50 is secured to a bracket 52, which includes a pair of mounting flanges 54 that are secured to carriage 20. In the illustrated embodiment, flanges 20 are secured to the underside of horizontal frame member 28 via bolt and nut connectors 56, although it is understood that any other satisfactory type of mounting method may be employed. Bracket 52 further includes a vertically offset central section including a pair of spaced apart side walls 58 and a lower wall 60. An upstanding, forwardly facing mounting wall 62 extends upwardly from the forward edge of lower wall 60.

A pair of tracking rollers 64 is secured to lower wall 60 of bracket 52. Tracking rollers 64 are in horizontal alignment with each other, and the spacing between tracking rollers 64 is only slightly greater than the width of support bar 46 of rail 18. Tracking rollers 64 are positioned on carriage 20 so as to be located below the lower extent of wheel 22, and are adapted to engage the upper side surfaces of support bar 46 to maintain carriage 20 in a proper lateral position relative to rail 18, i.e. to ensure that wheel 22 maintains engagement with support surface 48 of support member 46. While tracking rollers 64 are illustrated, it is also understood that a similar function may be provided by a circular rib that extends outwardly from the outwardly facing engagement surface of wheel 22 and is received within a groove formed in support surface 48 of support member 46. In addition, it is understood that tracking rollers 64 may be mounted in any other satisfactory location on carriage 20. Each tracking roller 64 is rotatably supported on a vertical roller shaft 66, each of which extends through an opening in bracket lower wall 60 for engagement with a threaded nut (not shown), to secure tracking rollers 64 in position on bracket 52.

Anti-tip member 50 is pivotably mounted to mounting wall 62 of bracket 52 via a pivot pin 68 for movement between an operative position as shown in FIG. 2 and an inoperative position (not shown). Pivot pin 68 extends through an opening in mounting wall 62 and an aligned opening in anti-tip member 50. A retainer pin 69 is selectively engageable with anti-tip member 50 and mounting wall 62 for releasably retaining anti-tip member 50 in the operative position. The construction and operation of anti-tip member 50 is shown and described in greater detail in copending patent application Ser. No. 10/354,417 filed Jan. 30, 2003, the disclosure of which is hereby incorporated by reference.

Referring to FIG. 3, rail 18 is defined by a series of aligned rail sections, two of which are shown at 18*a* and 18*b*. Hereafter, the designations "a" and "b" will be used to denote the components described previously with respect to rail 18 and which are associated with rail sections 18*a* and 18*b*, respectively. Rail section 18*a* includes channel or base member 32*a* and support member 46*a*, and rail section 18*b* includes channel or base member 32*b* and support member 46*b*. FIGS. 3 and 4 illustrate the manner in which rail sections 18*a* and 18*b* are spliced or joined together.

With reference to FIGS. 3 and 4, bottom wall 34*a* of base member 32*a* terminates in an end 70*a*, and side walls 36*a* of base member 32*a* terminate in ends 72*a*. Similarly, bottom wall 34*b* of base member 32*b* terminates in an end 72*b*, and side walls 36*b* of base member 32*b* terminate in ends 72*b*.

The end of support member 46*a*, shown at 74*a*, is spaced inwardly from end 70*a* of bottom wall 34*a*. Conversely, the end of support member 46*b*, shown at 74*b*, extends outwardly beyond end 70*b* of bottom wall 34*b* of base member 32*b*. A vertical groove or recess 76 is formed in end 74*b* of support member 46*b*, and a tongue 78 extends outwardly from end 74*a* of support member 46*a*. The portion of support member 46*b* that extends outwardly from end 70*b* of base member 32*b* is shown at 80.

Rail sections 18*a* and 18*b* are adapted to be positioned together as shown in FIG. 4, in which ends 70*a*, 70*b* of bottom walls 34*a*, 34*b*, respectively, are located adjacent each other and ends 72*a*, 72*b* of side walls 36*a*, 36*b*, respectively, are located adjacent each other. Base members 32*a*, 32*b* may be positioned such that wall ends 70*a*, 70*b* and 72*a*, 72*b* physically touch or engage each other, or may be spaced slightly apart. In either event, the positioning of rail sections 18*a*, 18*b* is such that the outwardly extending portion 80 of support member 46*b* extends beyond end 70*a* of base member bottom wall 34*a*. Rail section 18*b* is positioned relative to rail section 18*a* such that tongue 78 is received within groove 76, as shown in FIG. 4.

In a representative embodiment, support members 46*a* and 46*b* have a height of 1.00 inches and a width of 0.669 inches, and outwardly extending portion 80 of support member 46*b* has a length of approximately 1.00 inches that extends beyond end 70*b* of bottom wall 34*b*, which represents a ratio of 1:1 with respect to the height dimension of support members 46*a* and 46*b*. In this manner, the joint between support members 46*a* and 46*b* is axially offset from the joint between base members 32*a* and 32*b*, so that the joint between support members 46*a* and 46*b* overlies bottom wall 34*a* of base member 32*a*. The length of outwardly extending portion 80 and the underlying area of base member bottom wall 34*a* is sufficient to ensure that any vertical forces resulting from movement of carriage wheels 22 from one of support members 46*a*, 46*b* to the other are transferred to bottom wall 34*a* of base member 32*a*. In this manner, such forces are distributed over the area of bottom wall 34*a* surrounding the joint between support members 46*a* and 46*b*, to isolate the bottom wall ends 70*a* and 70*b* from experiencing any such forces. The material and thickness of bottom wall 34*a* is selected such that bottom wall 34*a* is capable of withstanding such forces and thereby preventing the grout beneath the joint between support members 46*a* and 46*b* from experiencing such forces. Further, bottom wall 32*a* functions to prevent any such forces from being applied to the grout at the location of the joint between base members 32*a* and 32*b*, to maintain the vertical position of support surfaces 48*a*, 48*b* of support members 46*a*, 46*b*, respectively, relative to each other and to thereby prolong the life of the rail sections 18*a*, 18*b* and the grout located below rail sections 18*a*, 18*b*.

Tongue 78 and groove 76 are configured such that the side edges of tongue 78, which face in opposite directions, are in close proximity to the facing side walls of groove 76. With this arrangement, engagement of tongue 78 within groove 76 maintains support members 46*a*, 46*b* in horizontal alignment with each other and functions to reduce lateral cantilever loads on end portion 80 of support member 46 caused by engagement of tracking rollers 64 with the sides of support member 46. It is also understood that a dual flange wheel may be employed in place of tracking rollers 64, and that engagement of tongue 78 within groove 76 functions to reduce cantilever forces on end portion 80 caused by the dual flange wheel. It can thus be appreciated that the positioning of the joint between support members 46*a* and 46*b* over base member bottom wall 34*a*, in combination with engagement of tongue 78 within groove 76, functions to ensure that support members 46*a* and 46*b* remain in vertical and horizontal alignment subsequent to installation.

As shown in FIG. 4, base members 32*a*, 32*b* include openings 82*a*, 82*b*, respectively, which are adapted to receive levelers, in a manner as is known, to adjust the vertical position of rail sections 18*a*, 18*b*. In this manner, the user is able to level rail sections 18*a*, 18*b* and to vertically align support surface 48*a* of rail section 18*a* with support surface 48*b* of rail section 18*b*. Subsequent to such leveling and vertical alignment of support surfaces 48*a* and 48*b*, grout is applied to the space below base member bottom walls 34*a* and 34*b* and subfloor 38, in a known manner, to fix the elevation of each of rail sections 18*a*, 18*b*. A finish layer of concrete is then typically applied over subfloor 38 to raise the floor elevation to the elevation of lip 40.

FIG. 5 illustrates an alternative construction for rail sections 18*a* and 18*b*. In this construction, groove 76 is formed in end 74*a* of support member 46*a*, and tongue 78 extends from end 74*b* of support member 46*b*. The construction of FIG. 5*b* operates in a similar manner to the construction of FIG. 4 to maintain support members 18*a*, 18*b* in alignment with each other and to isolate the joint between base members 32*a*, 32*b* from the vertical loads experienced when the carriage moves over the joint between support members 46*a*, 46*b*.

FIGS. 6 and 7 show another embodiment for the rail sections that can be joined together using the splice arrangement of the present invention. In this embodiment, a pair of rail sections 19*a*, 19*b* include respective base members 33*a*, 33*b* having a generally flat, plate-like configuration. Support members 47*a*, 47*b* are mounted to base members 33*a*, 33*b*, respectively. Support members 47*a*, 47*b* are configured similarly to support members 46*a*, 46*b*, with the exception that longitudinal grooves 49*a*, 49*b* are formed in the upwardly facing support surfaces of support members 47*a*, 47*b*, respectively. Grooves 49*a*, 49*b* are in alignment, and are configured to receive an outwardly extending peripheral tracking rib 51 formed on each carriage wheel 22'. In this version, a groove 76' is formed in the end of support member 47*a*, and a tongue 78' extends outwardly from the end of support member 47*b*. Tongue 78' extends outwardly from the end of support member 46*b* below the floor of groove 49*b*, such that the upper extent of tongue 78' is flush with the floor of groove 49*a*. In the same manner as described previously, tongue 78' is received in groove 76' to align support members 47*a*, 47*b* and to distribute the vertical forces to base member 33*a* that are caused when wheel 22' moves between support members 47*a*, 47*b*. It is also understood that a reverse configuration may be employed, in which tongue 78' projects from the end of support member 47*b* and groove 76' is formed in the end of support member 47*a*.

FIGS. 8 and 9 illustrate a mounting arrangement by which the support members such as 46*b* are secured to the base members such as 32*b*. A keyhole opening 84 is formed in bottom wall 34*b*, and is located such that support member 46*b* overlies keyhole opening 84. The edges of opening 84 are welded to the bottom surface of support member 46*b*, as shown at 86 (FIG. 6), to secure support member 46*b* to base member 32*b*.

Figure 11:
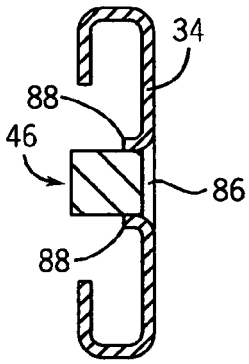
FIG. 11 is a section view taken along line 11—11 of FIG. 10.
Figure 12:
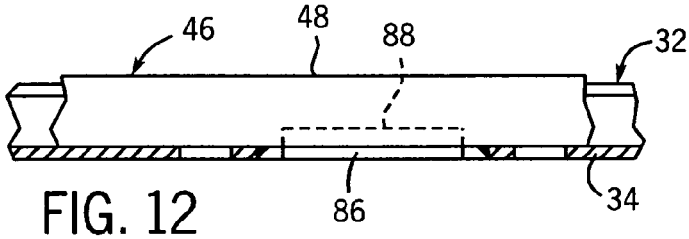
FIG. 12 is a partial section view taken along line 12—12 of FIG. 10.

FIGS. 10–12 illustrate a known manner in which the support member, generically shown at 46, is laterally positioned relative to the base member, generically shown at 32. The bottom wall 34 of base member 32 is formed with an opening 86, the edges of which are defined by upturned tab sections 88 which consist of upwardly deflected portions of the material of bottom wall 34. Tab sections 88 are configured and arranged such that engagement of support member 46 between tab sections 88 functions to establish frictional engagement of the side surfaces of support member 46 with the facing surfaces of tab sections 88. Openings such as 86 and tab sections such as 88 are spaced apart at intermittent locations along the length of base member 32, to provide proper positioning of support member 46 relative to base member 32 throughout the length of support member 46 and base member 32 prior to connection of support member 46 to base member 32 as shown in FIGS. 5 and 6.

Figure 13:
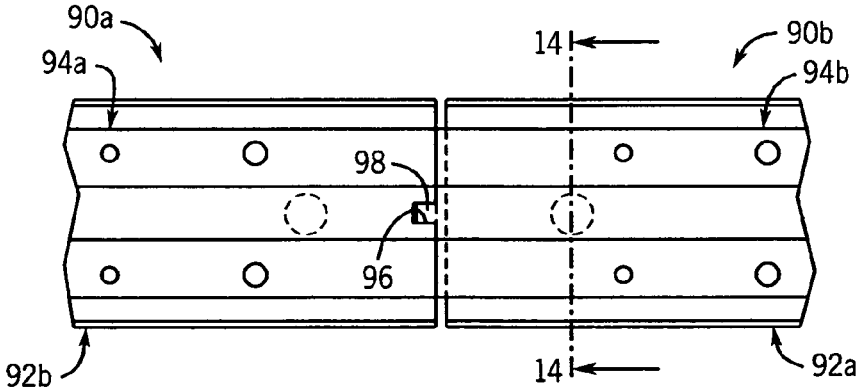
FIG. 13 PRIOR ART
FIG. 13 is a top plan view of a prior art splice arrangement for a pair of aligned rail sections.
Figure 14:
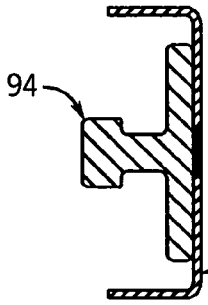
FIG. 14 PRIOR ART
FIG. 14 is a section view taken along line 14—14 of FIG. 13.

FIGS. 13 and 14 illustrate a prior art splice arrangement, in which a pair of rail sections 90*a*, 90*b* are each formed by a U-shaped base member 92 and a rail member 94. Alternatively, each rail member 94 may be utilized without base member 92. In this application, the end of rail member 94 is at the same location as the end of base member 92, which results in the end of base member 92 experiencing the vertical forces that result from carriage wheels 22 moving from one rail section to another. In this prior art construction of FIGS. 13 and 14, one of rails 94 is provided with a slot 96 and the other of rail members 94 includes a tongue 98 engageable within slot 96, to maintain horizontal alignment between the rails 94 of adjacent rail sections 90*a*, 90*b*.

The prior art splice arrangement of FIGS. 10–12 utilizes a splice plate and associated hardware to connect the ends of the rail sections 90*a*, 90*b* together. In contrast, the splice arrangement of the present invention does not require use of a splice plate, such that the splice plate and associated hardware are eliminated. This substantially simplifies installation and reduces the overall part count of the rail assembly.

While the invention has been shown and described with respect to a specific embodiment, it is understood that various alternatives and modifications are possible and contemplated as being within the scope of the invention. For example, and without limitation, the horizontal alignment between the aligned support member sections is shown as a tongue and groove arrangement. It is also understood that any other type of horizontally stable engagement structure may be employed, such as a dowel and passage arrangement, a threaded engagement member or the like. Further, while the bottom wall of the base member underlying the joint between the support member sections is shown a being a planar wall, it is understood that the area under the joint between the support member sections may have any suitable construction or configuration, so long as it is capable of withstanding the vertical forces applied at the joint during movement of the carriage. In addition, it is understood that the specific configuration of the base member may vary from the channel configuration as shown and described, and that any other type of base or support structure may underlie the support sections. It is further understood that the specific configuration of the support member may vary from the rectangular configuration as shown and described, and that the support member may have any satisfactory shape having an upwardly facing support surface and which is capable of functioning as a rail.

Various alternatives and embodiments are contemplated as being within the scope of the following claims particularly pointing out and distinctly claiming the subject matter regarded as the invention.

I claim:

1. A mobile storage system, comprising:

a rail arrangement; and one or more mobile storage units movably mounted to the rail arrangement;

wherein the rail arrangement comprises a rail base and a support member;

wherein the rail base includes at least first and second aligned base sections, wherein the first and second base sections define first and second adjacent ends, respectively, that form a joint in the base, wherein each base section includes a transverse lower wall defining an upwardly facing surface, wherein the transverse lower walls of the base sections face and engage each other at the joint in the base;

wherein the support member includes first and second aligned support member sections, wherein the first and second support member sections define first and second adjacent ends, respectively, that form a joint in the support member, wherein each support member section defines a rectangular cross section and includes an upwardly facing surface engageable with the one or more storage units and a downwardly facing surface facing the base, and wherein the joint in the support member includes a vertically extending tongue extending outwardly from one of the first and second adjacent ends between the upwardly facing surface and the downwardly facing surface of one of the rail sections, and a vertically extending groove extending inwardly from the other of the first and second adjacent ends between the upwardly facing surface and the downwardly facing surface of one of the rail sections, wherein the tongue is engaged within the groove and maintains the first and second rail sections in horizontal alignment with each other;

wherein the first and second base sections and the first and second support member sections are arranged such that the joint in the support member is axially offset from the joint in the base;

wherein the upwardly facing surfaces of the transverse lower walls of the first and second base sections extend laterally outwardly of the first and second support member sections, respectively, and wherein the joint between the support members overlies and is supported by the transverse lower wall of one of the first and second base sections.

2. The mobile storage system of claim 1, wherein the first base section and the first support member section are connected together to form a first rail section, and wherein the second base section and the second support member section are connected together to form a second rail section.

3. A rail construction for a mobile system in which a movable member is adapted to be supported by a rail, comprising a first rail section and a second rail section adapted to be positioned in alignment with each other, wherein the first rail section comprises a first base member having a transverse lower wall defining an end and a first support member defining an end, wherein the end of the first support member is axially offset from the end of the transverse lower wall of the first base member, and wherein the second rail section comprises a second base member having a transverse lower wall defining an end and a second support member defining an end, wherein the end of the second support member is axially offset from the end of the transverse lower wall of the second base member, wherein the first and second rail sections are positioned such that the end of the transverse lower wall of the first base member and the end of the transverse lower wall of the second base member are located adjacent each other to form a transverse joint therebetween, and such that the end of the first support member and the end of the second support member are located adjacent each other to form a joint therebetween, wherein the joint between the first and second base members and the joint between the first and second support members are axially offset from each other and wherein the joint between the support members overlies and is supported by the lower wall of one of the first and second base members, wherein the transverse wall of each of the first and second base members defines an upwardly facing surface, and wherein the upwardly facing surfaces of the transverse lower walls of the first and second base sections extend laterally outwardly of the first and second support member sections, respectively, and wherein each support member defines a rectangular cross section and includes an upwardly facing surface engageable with the movable member and a downwardly facing surface facing one of the base members, and wherein the joint between the support members includes a vertically extending tongue extending outwardly from the end of one of the support members between the upwardly facing surface and the downwardly facing surface, and a vertically extending groove extending inwardly from the end of the other of the support members between the upwardly facing surface and the downwardly facing surface and within which the tongue is received, wherein engagement of the tongue within the groove maintains the first and second rail members in horizontal alignment with each other.

4. A rail construction for a mobile system in which a movable member is adapted to be supported by a rail, comprising a first rail section and a second rail section adapted to be positioned in alignment with each other, wherein the first rail section comprises a first base member having a transverse lower wall defining an end and a first support member defining an end, wherein the first support member is separate from the first base member and is secured to the first base member, wherein the end of the first support member is axially offset from the transverse lower wall of the first base member, and wherein the second rail section comprises a second base member having a transverse lower wall defining an end and a second support member defining an end, wherein the second support member is separate from the second base member and is secured to the second base member, wherein the end of the second support member is axially offset from the transverse lower wall of the second base member, wherein the first and second rail sections are positioned such that the end of the transverse lower wall of the first base member and the end of the transverse lower wall of the second base member are located adjacent each other to form a transverse joint therebetween, and such that the end of the first support member and the end of the second support member are located adjacent each other to form a joint therebetween, wherein the joint between the first and second base members and the joint between the first and second support members are axially offset from each other and wherein the joint between the support members overlies and is supported by the lower wall of one of the first and second base members, wherein the first and second base members each further includes a pair of side walls extending upwardly from opposite sides of the transverse lower wall, wherein the side walls are located one on either side of the support member.

5. The rail construction of claim 4, wherein the end of the first support member includes a projection and the end of the second support member includes a recess, wherein the projection is adapted for engagement within the recess and wherein the recess and the projection are configured to prevent lateral movement between the first and second support members to maintain the first and second support members in alignment with each other.

6. The rail construction of claim 5, wherein the recess in the end of the second support member is oriented so as to extend substantially vertically, and wherein the projection in the end of the first support member extends substantially vertically and is configured such that oppositely facing edges defined by the projection face and engage facing walls defined by the recess to maintain the first and second support members in alignment with each other.

7. In a rail arrangement for a mobile system including a rail-mounted movable member, wherein the rail arrangement includes a pair of support members, each of which defines a support surface adapted to support the movable member, the improvement comprising a pair of base members located below the pair of support members, wherein each base member defines a transverse lower wall defining an upwardly facing surface and wherein the pair of base members are aligned with each other and define adjacent ends that cooperate to form a joint therebetween, wherein each support member is separate from and secured to one of the transverse lower walls, and wherein the pair of support members are located in alignment with each other, wherein the support members define facing ends that are located adjacent each other to form a joint therebetween, wherein the joint between the pair of support members is located so as to be axially offset from the joint between the pair of base members such that the joint between the support members overlies and is supported by the transverse lower wall of one of the base members, and wherein each of the support members defines a downwardly facing surface that faces and engages the upwardly facing surface of one of the base members, and wherein the upwardly facing surfaces of the transverse lower walls of the base members extend laterally outwardly of the first and second support members, respectively, and wherein each support member defines a rectangular cross section and includes an upwardly facing surface engageable with the one or more rail-mounted movable members and a downwardly facing surface facing one of the base members, and wherein the joint between the support members includes a vertically extending tongue extending outwardly from the end of one of the support members between the upwardly facing surface and the downwardly facing surface, and a vertically extending groove extending inwardly from the end of the other of the support members between the upwardly facing surface and the downwardly facing surface and within which the tongue is received, wherein engagement of the tongue within the groove maintains the first and second rail members in horizontal alignment with each other.

8. The improvement of claim 7, wherein each support member and its associated base member cooperate to form a rail section.

9. A method of joining a pair of rail sections, comprising the acts of:

providing first and second rail sections, wherein the first rail section includes a base member having a transverse lower wall and a support member, and wherein the second rail section includes a base member having a transverse lower wall and a support member, wherein the transverse lower wall of each of the base members defines an upwardly facing surface, and wherein each of the support members defines a downwardly facing surface that faces and engages the upwardly facing surface of one of the base members, and wherein the upwardly facing surfaces of the transverse lower walls of the base members extend laterally outwardly of the first and second support members, respectively;

positioning an end defined by the first rail section adjacent an end defined by the second rail section, wherein the rail sections are positioned such that the base member of the first rail section is located adjacent the base member of the second rail section to form a joint between the base members of the first and second rail sections; and engaging an end defined by the support member of the first rail section with an end defined by the support member of the second rail section to form a joint between the support members of the first and second rail sections, wherein the step of engaging the ends of the support members is carried out such that the joint between the ends of the support members is axially offset from the joint between the base members, and wherein the joint between the ends of the support members overlies and is supported by the transverse lower wall of one of the base members;

wherein each support member defines a rectangular cross section and includes an upwardly facing surface and a downwardly facing surface facing one of the base members, and wherein one of the support members includes a vertically extending tongue extending outwardly from the end of the support member between the upwardly facing surface and the downwardly facing surface, and the other of the support members includes a vertically extending groove extending inwardly from the end of the support member between the upwardly facing surface and the downwardly facing surface, and wherein the step of engaging the ends of the support members includes the step of engaging the tongue within the groove, wherein the tongue and the groove are configured such that engagement of the tongue within the groove functions to maintain the support members in alignment with each other.

10. A method of joining a pair of rail sections, comprising the acts of:

providing first and second rail sections, wherein the first rail section includes a base member having a transverse lower wall and a support member, and wherein the second rail section includes a base member having a transverse lower wall and a support member;

positioning an end defined by the first rail section adjacent an end defined by the second rail section, wherein the rail sections are positioned such that the base member of the first rail section is located adjacent the base member of the second rail section to form a joint between the base members of the first and second rail sections;

engaging an end defined by the support member of the first rail section with an end defined by the support member of the second rail section to form a joint between the support members of the first and second rail sections, wherein the step of engaging the ends of the support members is carried out such that the joint between the ends of the support members is axially offset from the joint between the base members, and wherein the joint between the ends of the support members overlies and is supported by the transverse lower wall of one of the base members;

wherein the step of engaging the ends of the support members includes the step of engaging a projection defined by the end of one of the support members within a recess defined by the end of the other of the support members, wherein the projection and the recess are configured such that engagement of the projection within the recess functions to maintain the support members in alignment with each other; and wherein each of the base members includes a pair of side walls extending upwardly from the transverse lower wall and wherein the support members are located between the side walls of the base members.

11. A rail construction for a mobile system in which a movable member is adapted to be supported by a rail, comprising a first rail section and a second rail section adapted to be positioned in alignment with each other, wherein the first rail section comprises a first base member having a transverse lower wall defining an end and a first support member defining an end, wherein the first support member is separate from the first base member and is secured to the first base member, wherein the end of the first support member is axially offset from the transverse lower wall of the first base member, and wherein the second rail section comprises a second base member having a transverse lower wall defining an end and a second support member defining an end, wherein the second support member is separate from the second base member and is secured to the second base member, wherein the end of the second support member is axially offset from the transverse lower wall, of the second base member, wherein the first and second rail sections are positioned such that the end of the transverse lower wall of the first base member and the end of the transverse lower wall of the second base member are located adjacent each other to form a transverse joint therebetween, and such that the end of the first support member and the end of the second support member are located adjacent each other to form a joint therebetween, wherein the joint between the first and second base members and the joint between the first and second support members are axially offset from each other and wherein the joint between the support members overlies and is supported by the lower wall of one of the first and second base members, wherein the transverse wall of each of the first and second base members defines an upwardly facing surface, and wherein each of the support member sections defines a downwardly facing surface that faces and engages the upwardly facing surface of one of the base sections, and wherein the upwardly facing surfaces of the transverse lower walls of the first and second base sections extend laterally outwardly of the first and second support member sections, respectively, wherein the first and second base members each further includes a pair of side walls extending upwardly from opposite sides of the transverse lower wall, wherein the side walls are located one on either side of the support member.

12. A method of joining a pair of rail sections, comprising the acts of:

providing first and second rail sections, wherein the first rail section includes a base member having a transverse lower wall and a support member, and wherein the second rail section includes a base member having a transverse lower wall and a support member, wherein the transverse lower wall of each of the base members defines an upwardly facing surface, and wherein each of the support members defines a downwardly facing surface that faces and engages the upwardly facing surface of one of the base members, and wherein the upwardly facing surfaces of the transverse lower walls of the base members extend laterally outwardly of the first and second support members, respectively;

positioning an end defined by the first rail section adjacent an end defined by the second rail section, wherein the rail sections are positioned such that the base member of the first rail section is located adjacent the base member of the second rail section to form a joint between the base members of the first and second rail sections; and engaging an end defined by the support member of the first rail section with an end defined by the support member of the second rail section to form a joint between the support members of the first and second rail sections, wherein the step of engaging the ends of the support members is carried out such that the joint between the ends of the support members is axially offset from the joint between the base members, and wherein the joint between the ends of the support members overlies and is supported by the transverse lower wail of one of the base members;

wherein each of the base members includes a pair of side walls extending upwardly from the transverse lower wall and wherein the support members are located between the side walls of the base members.

* * * * *

UNITED STATES PATENT AND TRADEMARK OFFICE

CERTIFICATE OF CORRECTION

PATENT NO. : 7,114,789 B2
APPLICATION NO. : 10/354364
DATED : October 3, 2006
INVENTOR(S) : William R. Keaton It is certified that error appears in the above-identified patent and that said Letters Patent is hereby corrected as shown below:

IN THE CLAIMS

CLAIM 11, column 12, line 33, after "wall" delete ",";

CLAIM 12, column 14, line 9, delete "wail" and substitute therefor -- wall --.

Signed and Sealed this

Thirtieth Day of September, 2008

JON W. DUDAS
*Director of the United States Patent and Trademark Office*